US006160537A

United States Patent [19]

Liu et al.

[11] Patent Number: 6,160,537

[45] Date of Patent: Dec. 12, 2000

[54] COMPUTER JOYSTICK FOR MOVING AN OBJECT IN THREE DIMENSIONS

[75] Inventors: Shu-Ming Liu, Taipe; A-Ming Chang, Lu-Chou, both of Taiwan

[73] Assignee: Primax Electronics Ltd., Taipei Hsien, Taiwan

[21] Appl. No.: 09/122,200

[22] Filed: Jul. 23, 1998

[51] Int. Cl.[7] ..... G09G 5/08

[52] U.S. Cl. ..... 345/161; 250/221

[58] Field of Search ..... 345/161, 156, 345/157, 158, 165, 166; 250/221, 229, 214 PR; 200/6 A, 6 R; 74/471 XY

[56] References Cited

U.S. PATENT DOCUMENTS 4,533,827 8/1985 Pincher ..... 250/221
5,621,207 4/1997 O'Mara ..... 250/221
5,847,694 12/1998 Redford ..... 345/161

*Primary Examiner*—Xiao Wu
*Attorney, Agent, or Firm*—Winston Hsu

[57] ABSTRACT

The present invention provides a computer joystick for controlling cursor or object movements in three dimensions. The computer joystick comprises a chassis, a control stick vertically installed on the chassis in a rotatable manner, a control stick sensor installed inside the chassis for detecting rotations of the control stick and generating corresponding stick position signals, a joystick handle comprising a vertical slot, and a rotation detector. The joystick handle is rotatably installed on the control stick through the vertical slot. The rotation detector comprises an optical panel fixed on the control stick, and a light sensor fixed inside the vertical slot of the joystick handle for detecting rotations of the joystick handle on the control stick and generating corresponding rotation signals.

4 Claims, 2 Drawing Sheets

COMPUTER JOYSTICK FOR MOVING AN OBJECT IN THREE DIMENSIONS

BACKGROUND OF THE INVENTION

1. Field of the Invention

The present invention relates to a computer joystick, and more particularly, a computer joystick for moving an object in three dimensions.

2. Description of the Prior Art

Computer joysticks are commonly used in computer games for controlling movements of a cursor or an object on a screen. Due to the complexity of current computer games, it is no longer adequate for computer joysticks to only control two-dimensional movements. Joysticks must now be able to control all types of object movements including those in the third dimension.

A typical computer joystick usually controls object movements in two dimensions through use of a control stick and controls object movements in the third dimension through use of either a button at the top of the control stick or a finger controlled sliding wheel. As object movements in different dimensions are separately controlled by different joystick components, control of the joystick is cumbersome.

SUMMARY OF THE INVENTION

It is therefore a primary objective of the present invention to provide a computer joystick to solve the above mentioned problem.

Briefly, in a preferred embodiment, the present invention provides a computer joystick comprising:

a chassis;

a control stick vertically installed on the chassis in a rotatable manner;

a control stick sensor installed inside the chassis for detecting rotations of the control stick and generating corresponding stick position signals;

a joystick handle having a vertical slot, the joystick handle being rotatably installed on the control stick through the vertical slot; and a rotation detector comprising:

an optical panel fixed on the control stick; and a light sensor fixed inside the vertical slot of the joystick handle for detecting rotations of the joystick handle on the control stick and generating corresponding rotation signals.

It is an advantage of the present invention that the control stick of the computer joystick controls all cursor or object movements in all three dimensions thus facilitating three-dimensional control input by the user.

This and other objectives and the advantages of the present invention will no doubt become obvious to those of ordinary skill in the art after having read the following detailed description of the preferred embodiment which is illustrated in the various figures and drawings.

DETAILED DESCRIPTION OF THE PREFERRED EMBODIMENT

Figure 1:
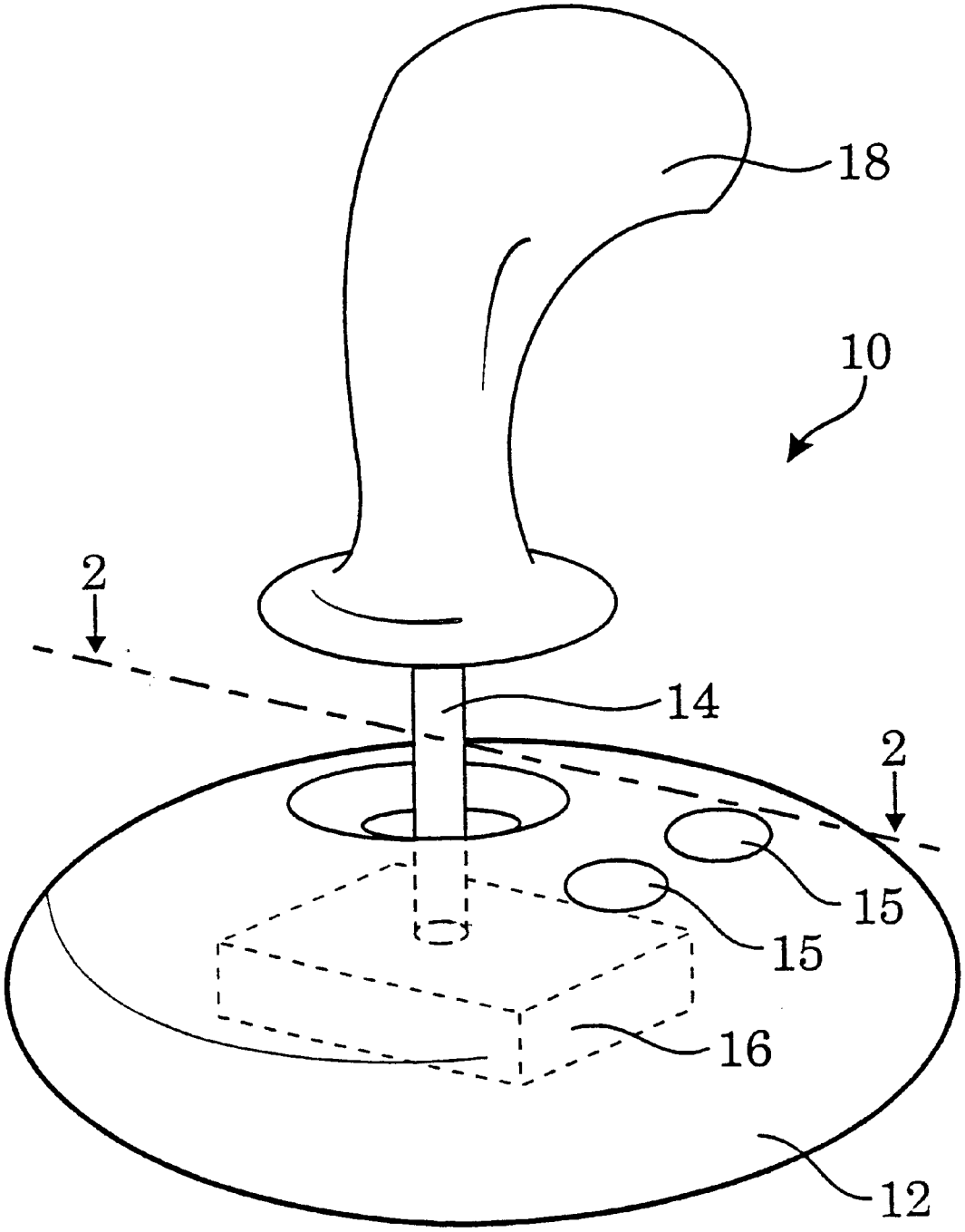
FIG. 1 is a perspective view of a computer joystick according to the present invention.

Please refer to FIG. 1. FIG. 1 is a perspective view of a computer joystick 10 according to the present invention. The computer joystick 10 comprises a chassis 12, a control stick 14 vertically installed on the chassis 12 in a rotatable manner, a plurality of functional keys 15 installed on the chassis 12 for issuing special instructions to a cursor or an object, a joystick handle 18 rotatably installed on the control stick 14, a control stick sensor 16 installed inside the chassis 12 for detecting rotating positions of the control stick 14 and generating corresponding position signals for controlling movements of the cursor or object on a two-dimensional plane.

Figure 2:
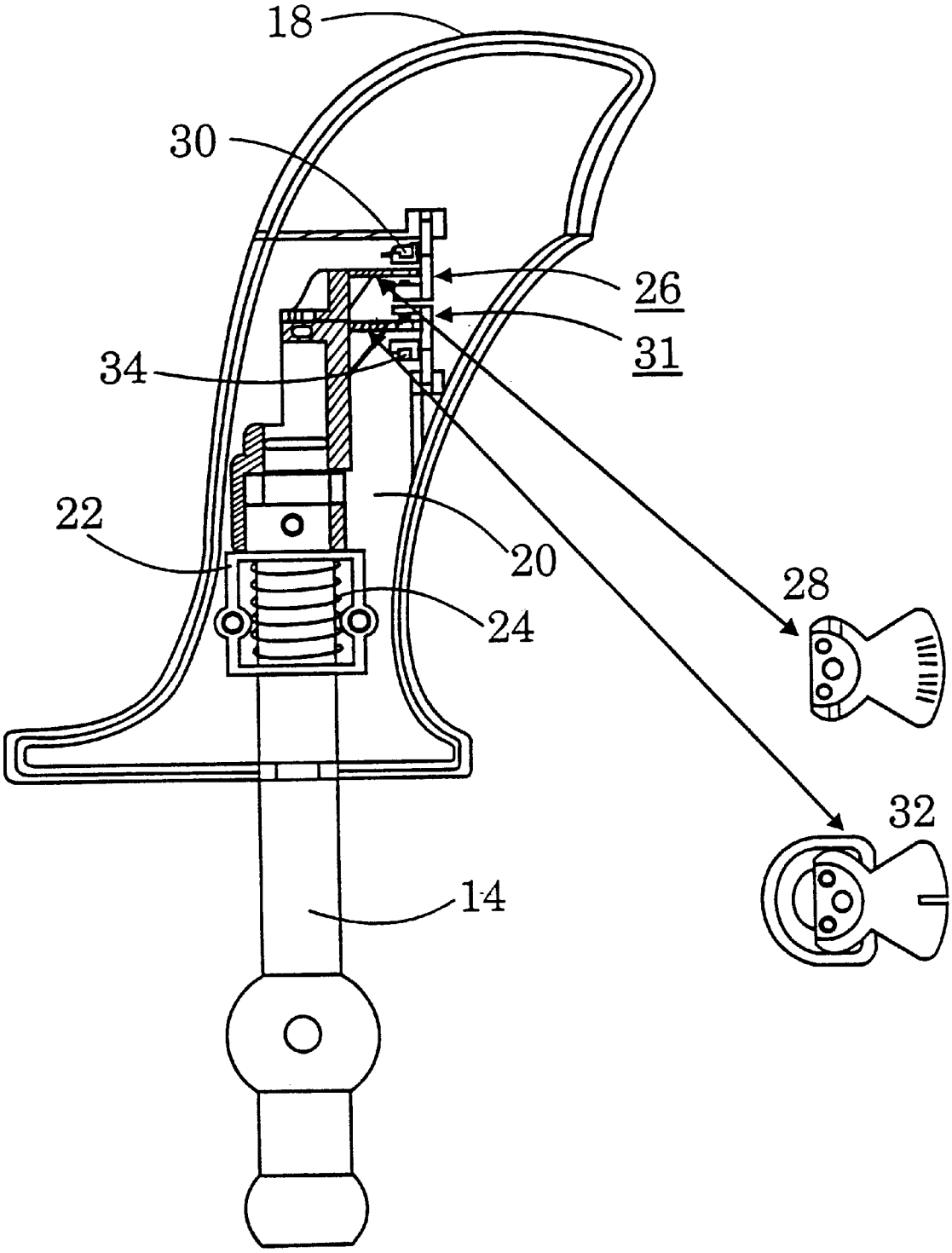
FIG. 2 is a sectional view along line 2—2 of the computer joystick in FIG. 1.

Please refer to FIG. 2. FIG. 2 is a sectional view along line 2—2 of the control stick 14. The joystick handle 18 comprises a vertical slot 20, a fixing device 22 installed between the vertical slot 20 of the joystick handle 18 and the control stick 14 for rotatably installing the joystick handle 18 on the control stick 14, an elastic device 24 installed between the vertical slot 20 and the control stick 14 to return the joystick handle 18 to an initial position after being rotated, a rotation detector 26 installed inside the vertical slot 20 for detecting the rotation of the joystick handle 18 and generating a corresponding rotation signal, and a handle position detector 31 for detecting the position of the top of the control stick 14 and generating a corresponding handle position signal.

The rotation detector 26 comprises an optical panel 28 fixed on the control stick 14, and a light sensor 30 fixed inside the vertical slot 20 of the joystick handle 18 next to the optical panel 28 for detecting rotations of the joystick handle 18 corresponding to the control stick 14 and generating a corresponding rotation signal for controlling movements of the cursor or object in a third dimension.

The handle position detector 31 comprises a position mark 32 fixed above the control stick 14 as a reference point, and a position sensor 34 fixed inside the vertical slot 20 of the joystick handle 18 for detecting movements of the top of the control stick 14 corresponding to the position mark 32 for controlling the movements of the cursor or object in the third dimension.

When a user rotates the control stick 14, the control stick sensor 16 inside the chassis 12 will detect the movement of the control stick 14 and generate a corresponding two-dimensional moving signal to control the movement of the cursor or object in the two-dimensional plane. When the user rotates the joystick handle 18 around a center of the control stick 14, the rotation detector 26 inside the joystick handle 18 will use the optical panel 28 fixed on the top of the control stick 14 and the light sensor 30 fixed inside the joystick handle 18 to detect the rotation of the joystick handle 18 relative to the control stick 14 so as to generate a corresponding rotation signal. Moreover, the handle position detector 31 inside the joystick handle 18 will use the position sensor 34 to generate a corresponding handle position signal according to the position mark 32 at the top of the control stick 14 as a reference point. The handle position signal and the rotation signal then determine the angular position of the joystick handle 18 to control movement of the cursor or object in the third dimension. Distances between gates of the optical panel are fixed thus making the range of possible angular positions predictable. Therefore, calibration of the rotation signals is not necessary.

Compared with the prior art computer joystick which uses different devices to control movements of the cursor or object in different dimensions, the computer joystick of the present invention uses the control stick 14 to control movements of the cursor or object in the two-dimensional plane and the joystick handle 18 of the control stick 14 to control the movements in the third dimension in a rotatable manner.

Moreover, the structure of the optical panel 28 makes it unnecessary to calibrate the rotation signals in the third dimension. Because the computer joystick of the present invention only uses the control stick 14 to input movements of the cursor or object in all three dimensions, it is very easy for the user to play games.

Those skilled in the art will readily observe that numerous modifications and alterations of the propeller may be made while retaining the teachings of the invention. Accordingly, the above disclosure should be construed as limited only by the metes and bounds of the appended claims.

What is claimed is:

1. A computer joystick comprising:

a chassis;

a control stick vertically installed on the chassis in a rotatable manner;

a control stick sensor installed inside the chassis for detecting rotations of the control stick and generating corresponding stick position signals;

a joystick handle having a vertical slot, the joystick handle being rotatably installed on the control stick through the vertical slot;

a rotation detector comprising:

an optical panel fixed on the control stick; and a light sensor fixed inside the vertical slot of the joystick handle for detecting rotations of the joystick handle on the control stick and generating corresponding rotation signals; and a handle position detector for detecting a predetermined position of the joystick handle and generating a hand e posit ion signal only upon detecting the joystick handle being positioned over the predetermined position.

2. The computer joystick of claim 1 further comprising a fixing device installed between the vertical slot of the joystick handle and the control stick for rotatably fixing the joystick handle on the control stick.

3. The computer joystick of claim 1 wherein the handle position detector comprises:

a position mark fixed on a predetermined position on top of the control stick; and a position sensor fixed inside the vertical slot of the handle for detecting the position mark on top of the control stick and generating a handle position signal upon detecting the position mark.

4. The computer joystick of claim 1 further comprising an elastic device installed between the vertical slot of the joystick handle and the top of the control stick for elastically moving the joystick handle back to an initial position after the joystick handle is rotated.

* * * * *